US010335648B2

(12) United States Patent
Kingston

(10) Patent No.: US 10,335,648 B2
(45) **Date of Patent: *Jul. 2, 2019**

(54) GOLF CLUB HEAD WITH HEEL-SIDE WEIGHT PLUG

(71) Applicant: Callaway Golf Company, Carlsbad, CA (US)

(72) Inventor: Keith L. Kingston, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/100,888

(22) Filed: Aug. 10, 2018

(65) Prior Publication Data

US 2019/0168085 A1 Jun. 6, 2019

Related U.S. Application Data

(63) Continuation of application No. 15/829,957, filed on Dec. 3, 2017, now Pat. No. 10,076,691.

(51) Int. Cl.
*A63B 53/04* (2015.01)

(52) U.S. Cl.
CPC .. *A63B 53/0466* (2013.01); *A63B 2053/0491* (2013.01)

(58) Field of Classification Search
CPC ..... A63B 53/0466; A63B 53/04; A63B 2053/0491; A63B 53/02; A63B 53/047; A63B 60/42
USPC ..... 473/338, 345
See application file for complete search history.

(56) References Cited

U.S. PATENT DOCUMENTS

| | | | | |
|---|---|---|---|---|
| 6,270,425 | B1 * | 8/2001 | Dyer | A63B 53/02 473/307 |
| 6,368,230 | B1 * | 4/2002 | Helmstetter | A63B 53/02 473/244 |
| 6,575,843 | B2 * | 6/2003 | McCabe | A63B 53/02 473/245 |
| 8,715,104 | B1 * | 5/2014 | Wall, Jr. | A63B 53/06 473/309 |
| 2009/0181791 | A1 * | 7/2009 | Sanchez | A63B 53/02 473/307 |
| 2012/0142445 | A1 * | 6/2012 | Burnett | A63B 53/06 473/307 |

* cited by examiner

*Primary Examiner* — Michael D Dennis
(74) *Attorney, Agent, or Firm* — Rebecca Hanovice; Michael Catania; Sonia Lari

(57) ABSTRACT

A golf club head comprising a body with a heel-side sole opening in communication with a hosel bore, a removable shaft sleeve with a tip sized to fit within the hosel bore, and a weight plug sized to fit within, and at least partially fill, the heel-side opening is disclosed herein. The weight plug, which has a base end with a through-opening, a tip end with a flange, and a side opening in communication with the through-opening, is connected to the shaft sleeve with a screw. When the golf club head is fully assembled, a hosel flange is trapped between the weight plug and the tip end of the shaft sleeve, and tightening the screw causes the weight plug and the shaft sleeve to move towards one another.

20 Claims, 8 Drawing Sheets

GOLF CLUB HEAD WITH HEEL-SIDE WEIGHT PLUG

CROSS REFERENCES TO RELATED APPLICATIONS

The present application is a continuation of U.S. patent application Ser. No. 15/829,957, filed on Dec. 3, 2017, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head having a removable heel-side weight plug. More specifically, the present invention relates to a golf club head having a hosel with a hosel bore and a heel side opening in communication with the hosel bore, a shaft sleeve that is removably affixed to the hosel, and a plug sized to fit within and at least partially fill the heel side opening. The present invention also relates to a golf club shaft sleeve and weight plug assembly.

Description of the Related Art

Various golf club manufacturers offer golf club heads with removable or adjustable shafts, which are affixed to the golf club heads with a shaft sleeve. See, for example, the Callaway GBB Epic Driver. Most of these club heads include a sole opening, in communication with a hosel bore, through which a screw is inserted to engage the shaft sleeve. While this structure serves to reversibly affix the shaft sleeve, and thereby the shaft, to the club head, the sole opening occupies a great deal of space, minimizing the area where manufacturers can add weight to increase the draw bias of the head. Therefore, there is a need for a golf club head with an adjustable or removable shaft sleeve assembly and improved draw bias structure.

BRIEF SUMMARY OF THE INVENTION

The present invention relates to a golf club head, and particularly club heads such as drivers, fairway-woods, and hybrids, comprising a heel-side sole opening in communication with a hosel bore, and a weight plug sized to fit within and fill at least a portion of the heel-side sole opening to increase the draw bias of the golf club head. The weight plug is reversibly fixed in place within the heel-side sole opening with a screw, which extends into the hosel bore to engage threads in a shaft sleeve affixed to a shaft.

One aspect of the present invention is a golf club head comprising a body comprising a face portion, a sole portion, a crown portion, a heel side, a toe side, and a heel-side opening extending into the sole portion, a hosel comprising a hosel bore and an internal hosel flange extending into and at least partially encircling the hosel bore, a shaft sleeve comprising a shaft sleeve tip end with an internally threaded opening, a first weight plug comprising a wall, a base end, a plug flange opposite the base end, a side opening extending into the wall proximate the plug flange, and a through-opening extending from the base end to the side opening, and a screw comprising a head portion, a midsection, and a threaded tip portion sized to engage the threads of the internally threaded opening in the shaft tip end, wherein the heel-side opening communicates with the hosel bore, wherein the first weight plug is sized to fit within the heel-side opening so that the base end is approximately flush with at least part of the sole portion, and wherein, when the first weight plug is disposed within the heel-side opening and the shaft sleeve is disposed within the hosel bore, the screw connects the weight plug to the shaft sleeve so that the internal hosel flange is sandwiched between the plug flange and the shaft tip end.

In some embodiments, the plug flange may be approximately U-shaped, the head portion of the screw may be disposed within the side opening of the first weight plug, and the plug flange may extend around a portion of the midsection of the screw. In other embodiments, the base end may be angled with respect to the first weight plug wall, and the first weight plug may have a width that tapers from a maximum width proximate the base end to a minimum width proximate the plug flange. In any of the embodiments, the wall of the first weight plug may have a varying thickness.

In further embodiments, the body may comprise a secondary weight port, which may be spaced from the heel-side opening, and the first weight plug may be sized to fit within the secondary weight port. In a further embodiment, the golf club head may further comprise a second weight plug, the first weight plug may have a first mass, and the second weight plug may have a second mass that is different from the first mass. In some embodiments, each of the first and second weights plug may be sized to fit within the heel-side opening and the secondary weight port, such that they are interchangeable. In some embodiments, the secondary weight port may extend into the toe side of the body. In any of the embodiments, the golf club head may further comprise a washer disposed between the head portion of the screw and the plug flange.

Another aspect of the present invention is a wood-type golf club head comprising a body comprising a sole portion, a crown portion, a heel side, a toe side, a hollow interior cavity, a hosel having a hosel bore and a hosel flange extending into the hosel bore, and a heel-side opening extending into the sole portion in communication with the hosel bore, a shaft sleeve comprising an internally threaded tip end, the tip end sized to fit within the hosel bore, a weight plug comprising a wall, a base end, a u-shaped flange opposite the base end, a side opening extending into the wall proximate the u-shaped flange, and a through-opening extending from the base end to the side opening, and a screw comprising a head portion, an unthreaded midsection, and an externally threaded tip portion sized to engage the internally threaded tip end of the shaft sleeve, wherein the weight plug is sized to fit within, and fill a majority of a volume of, the heel-side opening, wherein the base end is angled with respect to the weight plug wall, wherein the weight plug has a width that tapers from a maximum width proximate the base end to a minimum width proximate the plug flange, wherein, when the weight plug is disposed within the heel-side opening and the tip end of the shaft sleeve is disposed within the hosel bore, the screw connects the weight plug to the shaft sleeve so that the hosel flange is disposed between the plug flange and the shaft tip end, and wherein tightening the screw causes the weight plug and the shaft sleeve to move towards one another.

In some embodiments, the wood-type golf club head may further comprise at least one washer, which may at least partially encircle the unthreaded midsection of the screw. In other embodiments, the shaft sleeve may be composed of a first material, and the weight plug may be composed of a second material that differs from the first material. In some embodiments, the weight plug may have a mass of no more than 10 grams, and in others, the base end may be approximately flush with an external surface of the sole portion.

Yet another aspect of the present invention is an assembly comprising a golf club shaft sleeve comprising a tip end having a threaded internal bore, a weight plug comprising a wall, a base end, a u-shaped flange, a side opening, and a through opening extending from the base end to the flange and in communication with the side opening, and a screw comprising a head portion, an unthreaded midsection, and threaded tip portion, wherein the weight plug tapers in width from a maximum width proximate the base end to a minimum width proximate the flange, wherein the base end is angled with respect to the wall, wherein the head portion is disposed within the side opening so that the u-shaped flange extends around a portion of the unthreaded midsection, wherein the threaded tip portion engages the threaded internal bore, and wherein the screw reversibly attaches the weight plug to the shaft sleeve. In some embodiments, the wall of the weight plug may have a varying thickness. In other embodiments, the golf club shaft sleeve may be composed of a first material, and the weight plug may be composed of a second material that differs from the first material. In a further embodiment, the golf club shaft sleeve may be composed of an aluminum alloy, and the weight plug may be composed of a titanium alloy. In another embodiment, the weight plug may comprise a tungsten alloy. In yet another embodiment, the assembly may further comprise at least one washer and at least one o-ring, which may at least partially encircle the unthreaded midsection.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
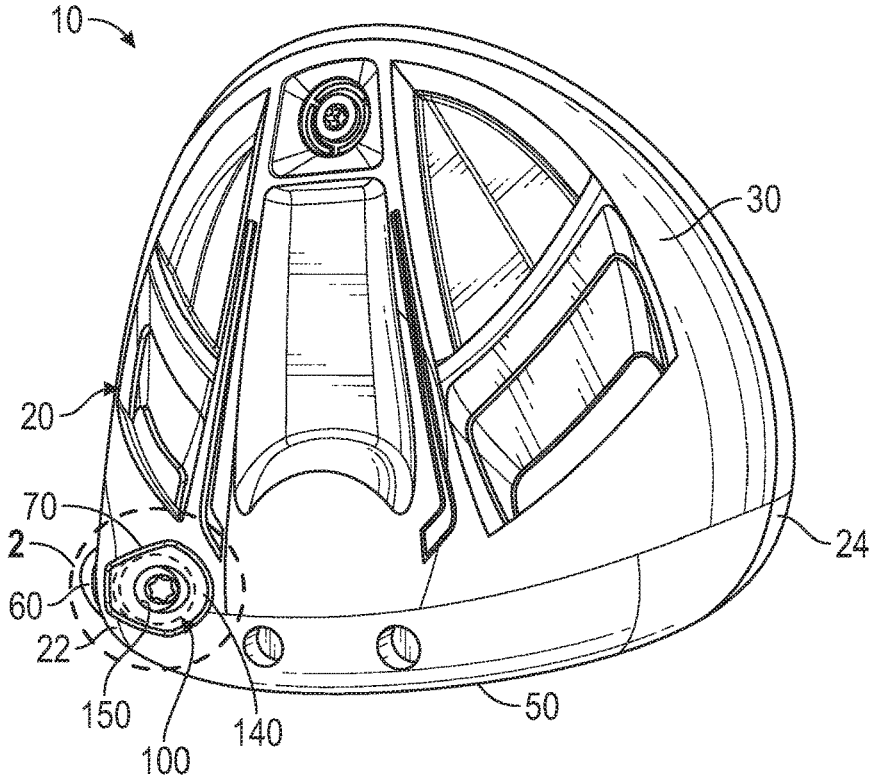
FIG. 1 is a sole perspective view of a first embodiment of the golf club head of the present invention.
Figure 2:
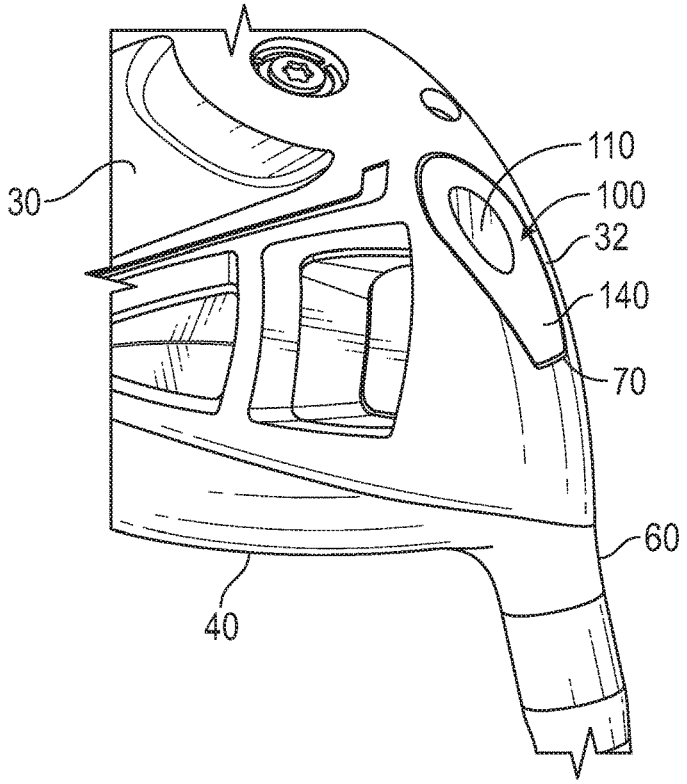
FIG. 2 is an enlarged, side perspective view of the circled portion of the embodiment shown in FIG. 1.
Figure 3:
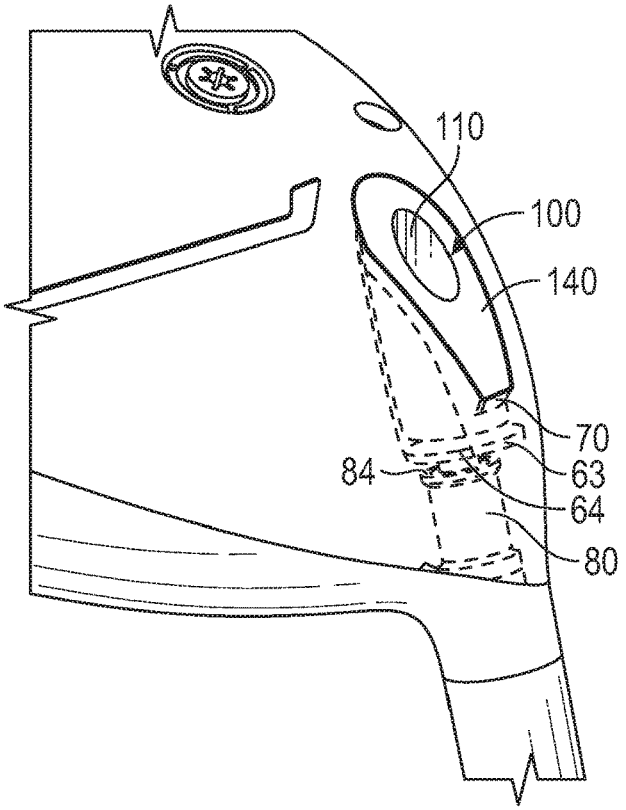
FIG. 3 is a partially transparent view of the embodiment shown in FIG. 2.
Figure 4:
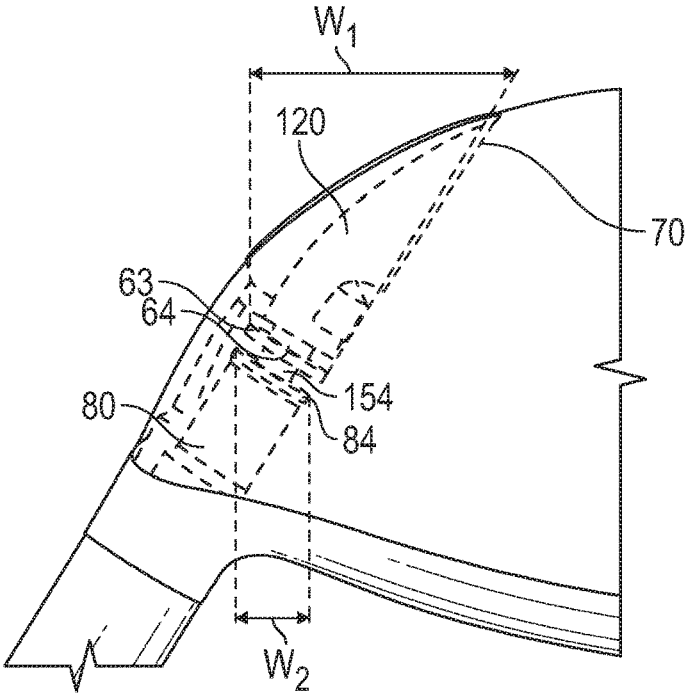
FIG. 4 is a front perspective view of the embodiment shown in FIG. 3.
Figure 5:
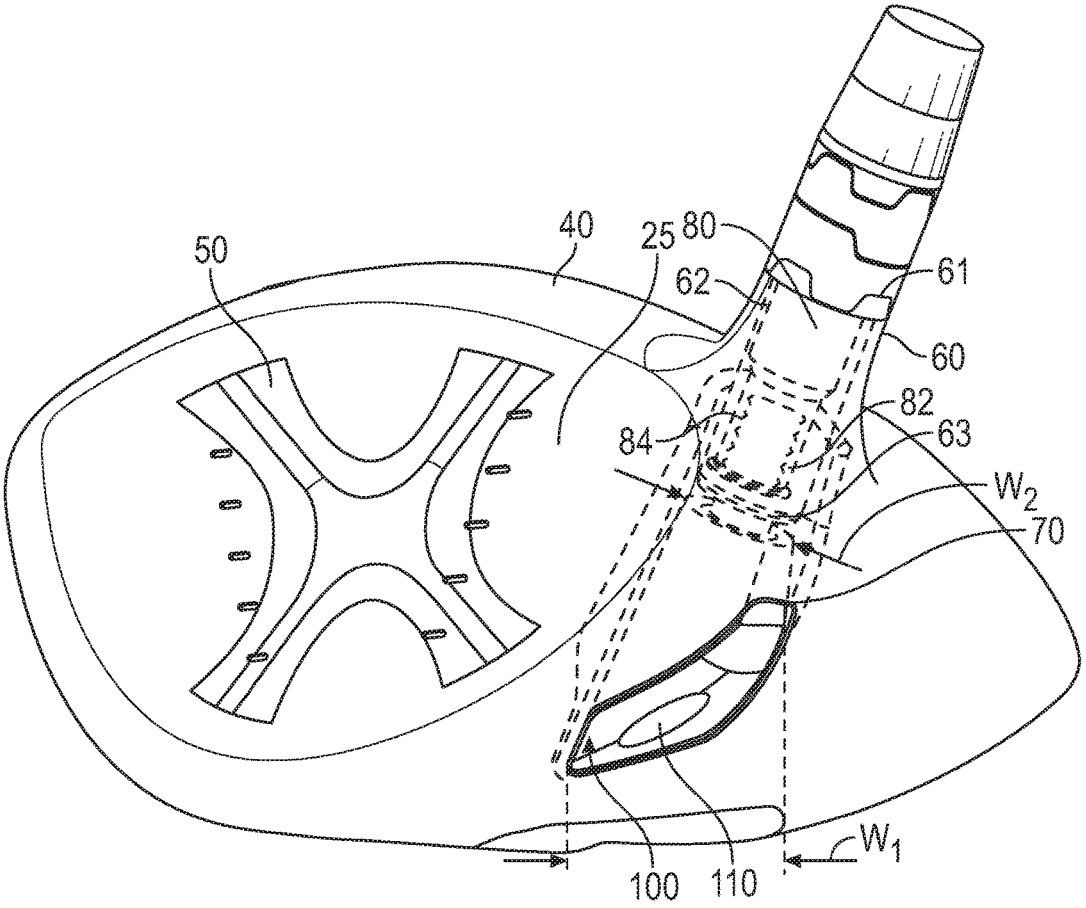
FIG. 5 is a front perspective view of the embodiment shown in FIG. 1.

The present invention is directed to a golf club head with improved draw bias weighting, and particularly a weight plug that fills an opening in the heel side below the hosel, where a shaft sleeve is affixed to the club head. The weight plug of the present invention fills previously unused space to focus mass at the lower heel side of the club head, thereby freeing up discretionary weight, which in prior art club heads would have been placed in other areas near the heel. This additional discretionary weight can be used to optimize the overall center of gravity of the club head and improve forgiveness.

A preferred embodiment of the present invention is shown in FIGS. 1-11. The golf club head 10, which in this embodiment is a driver, comprises a body 20 with a heel side 22, a toe side 24, a sole 30, crown 40, face 50, and hosel 60. The sole 30, crown 40, and face 50 connect with one another to define a hollow interior cavity 25. The hosel 60 has an upper edge 61 proximate the crown 40 and an internal hosel bore 62 that extends from the upper edge 61 to an internal flange 63 encircling a through-opening 64. The hosel bore 62 is sized to receive a shaft sleeve 80, which is connected to the tip end of a shaft (not shown), and which has a threaded sleeve bore 82 and a tip end 84 that, when the shaft sleeve 80 is fully engaged with the hosel 60, abuts the internal flange 63 so that the sleeve bore 82 is aligned with the through-opening 64. The shaft sleeve 80 may have any of the features disclosed in U.S. Pat. No. 9,174,097, the disclosure of which is hereby incorporated by reference in its entirety herein.

The hosel bore 62 communicates with a heel-side opening 70 extending into the sole 30. This heel side opening 70 has a tapering width that decreases from a maximum width W1 proximate the external surface 32 of the sole 30 to a minimum width W2 proximate the internal flange 63. The heel side opening 70 is disposed beneath the hosel 60 and proximate the face 50.

Figure 6:
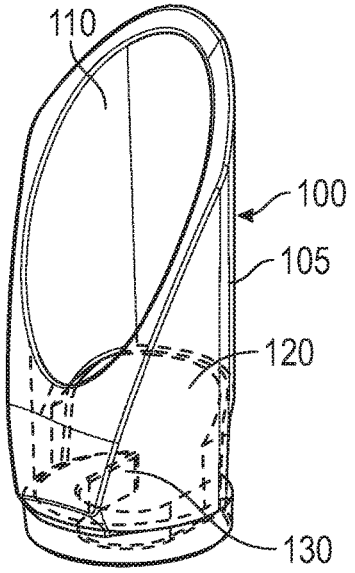
FIG. 6 is a side, partially transparent view of a weight plug of the present invention.
Figure 7:
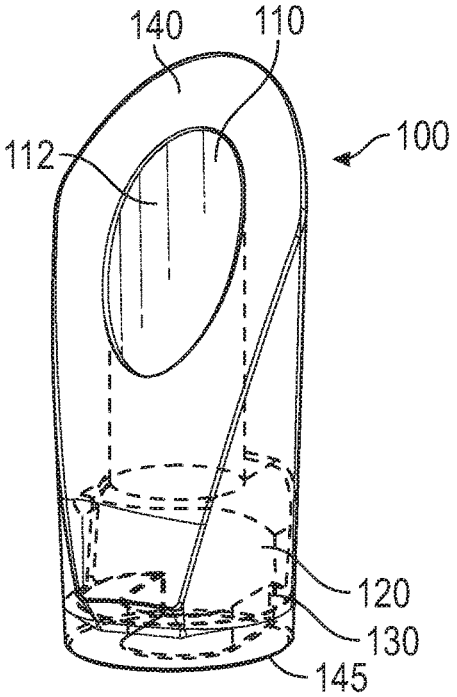
FIG. 7 is a side, partially transparent view of the weight plug shown in FIG. 1.
Figure 8:
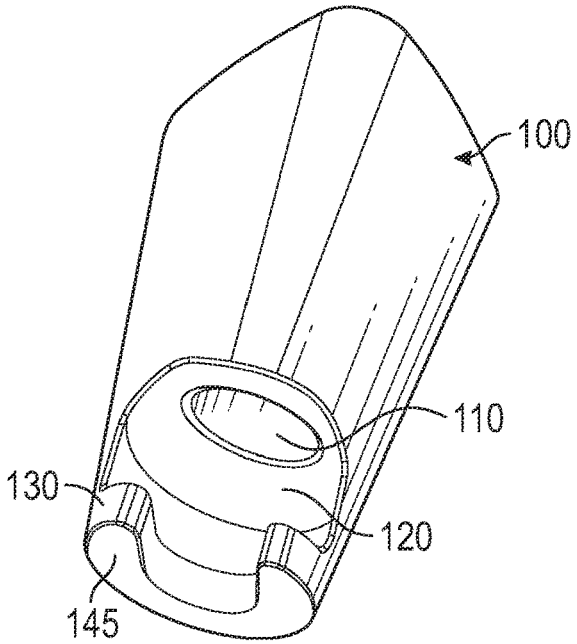
FIG. 8 is a side, perspective view of the weight plug shown in FIG. 1.

The weight plug 100 of the present invention is sized to fit within, and follow the contours of, the heel side opening 70, though it does not have to completely fill the heel side opening 70, and, when engaged with the golf club head 10, there is a slight spacing between the walls 105 of the weight plug 100 and the walls of the heel side opening 70. In general, the weight plug 100 has a width that tapers from a maximum width proximate the base end 140 to a minimum width proximate the tip end 145. The wall 105 of the weight plug 100 may have varying thicknesses, as shown in FIGS. 6 and 7, to adjust the overall mass of the weight plug 100. The weight plug 100 comprises a through-opening 110 extending from a base end 140 to a tip end 145 that communicates with a slotted side opening 120 in the weight plug wall 105 and a U-shaped flange 130 at the tip end 145. The base end 140 of the weight plug 100 is angled and contoured to match the outer mold line of the sole 30, and is at least partially flush with the external surface 32 of the sole 30 when the weight plug 100 is fully disposed within the heel-side opening 70, and the base-side end 112 of the through-opening 110 preferably is located on an opposite side of the weight plug 100 from the slotted side opening 120. The base end 140 may be painted or otherwise decorated so that, when engaged with the golf club head 10, the weight plug 100 blends in with the sole 30.

Figure 9:
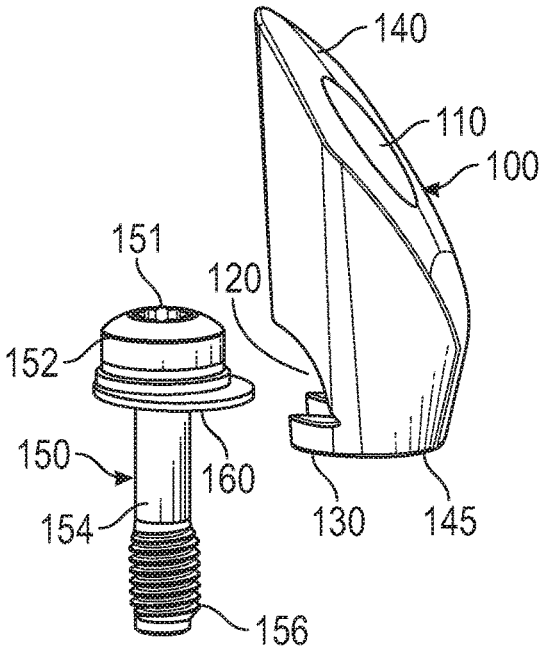
FIGS. 9-10 are side perspective, exploded views of the weight plug and screw shown in FIG. 1.
Figure 10:
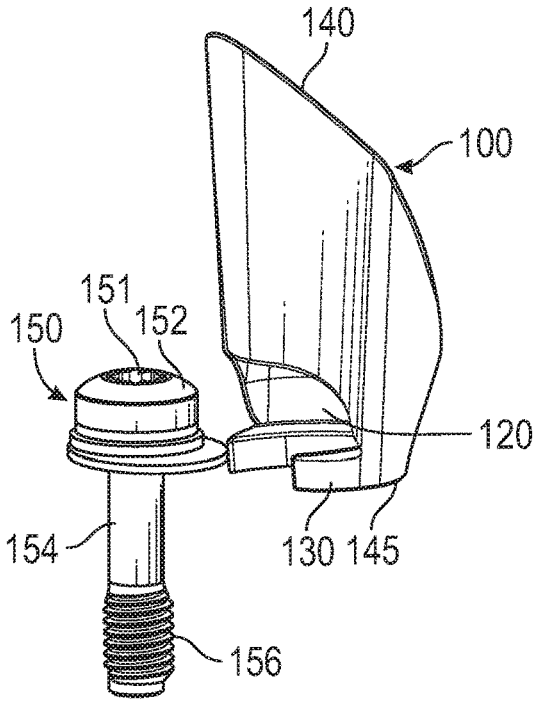
Figure 11:
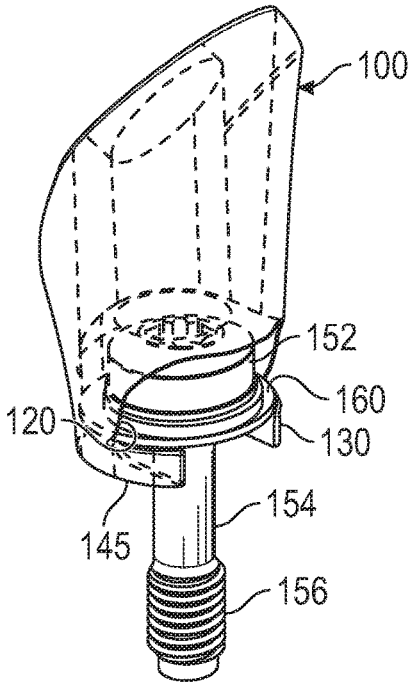
FIG. 11 is a side, perspective view of the weight plug and screw shown in FIGS. 9-10 engaged with one another.
Figure 12:
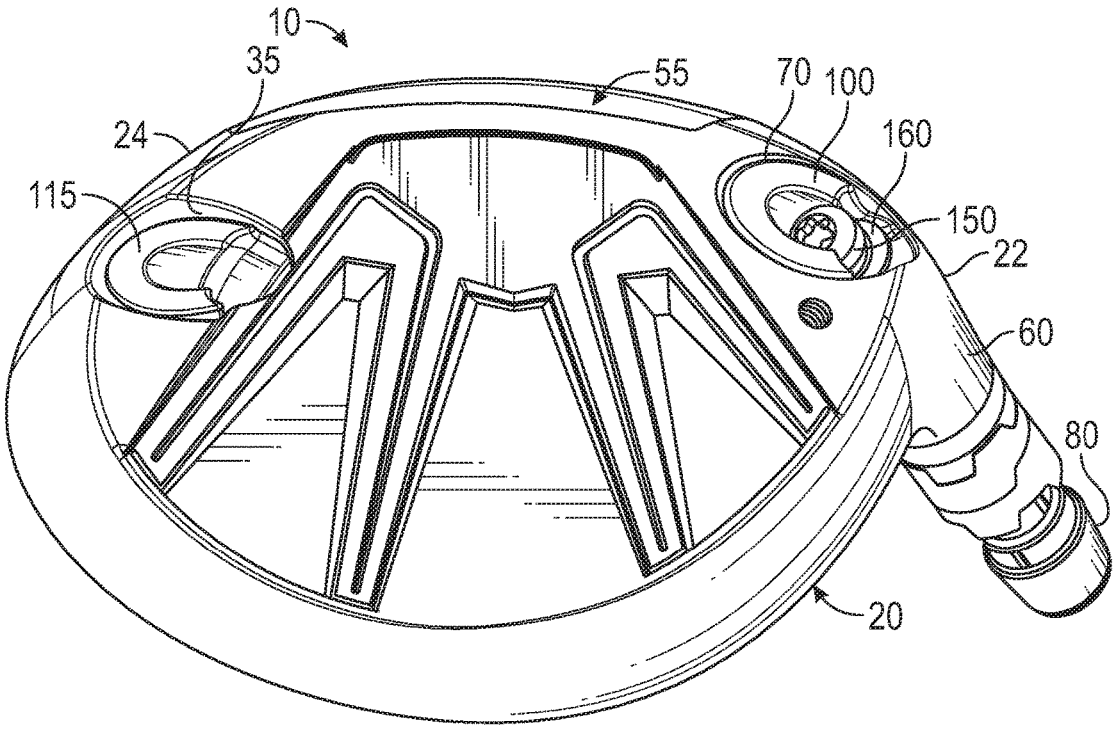
FIG. 12 is a sole, perspective view of an alternative embodiment of the golf club head of the present invention.
Figure 13:
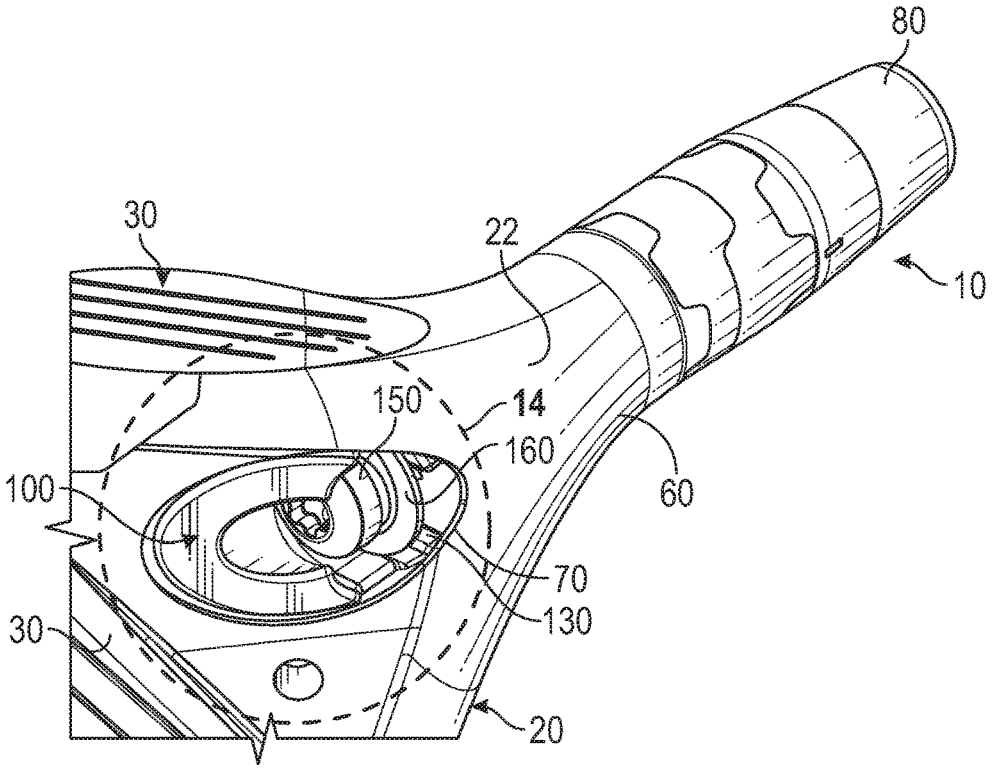
FIG. 13 is a heel side perspective view of the embodiment shown in FIG. 12.
Figure 14:
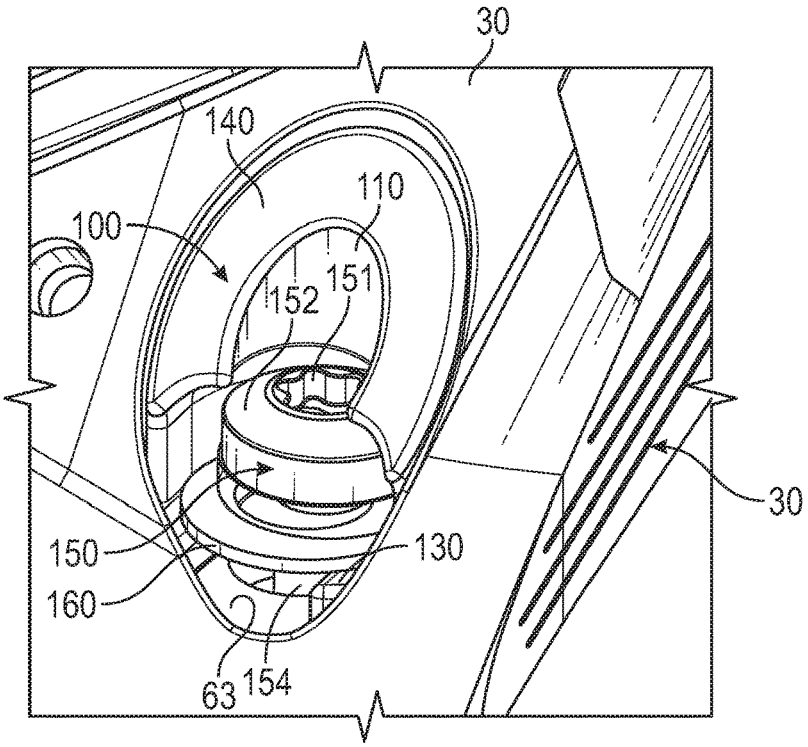
FIG. 14 is an enlarged view of the circled portion of the embodiment shown in FIG. 13.
Figure 15:
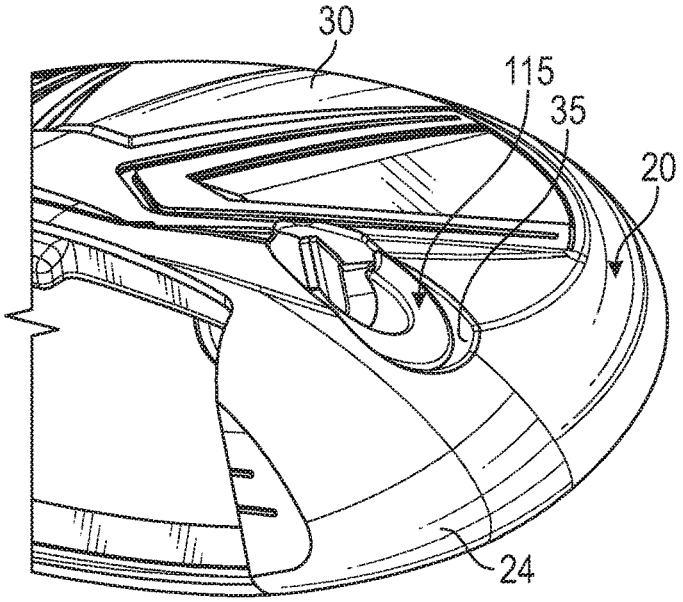
FIG. 15 is a toe side perspective view of the embodiment shown in FIG. 12 without its face component.
Figure 16:
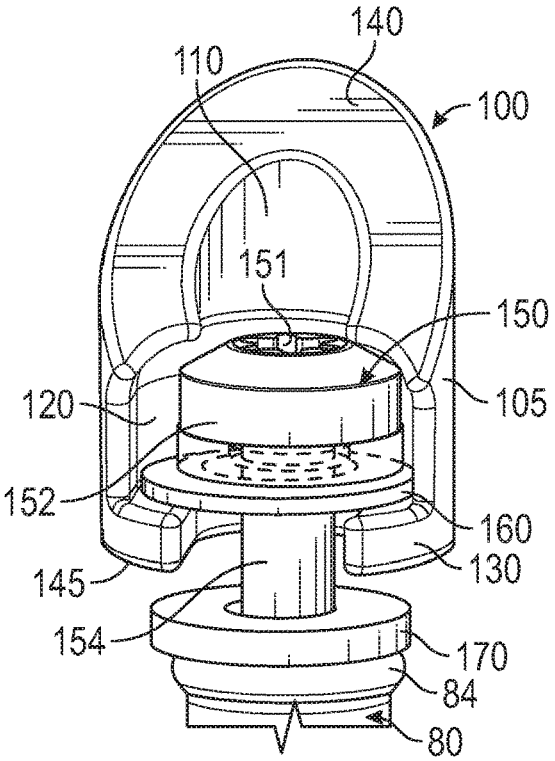
FIG. 16 is a side elevational view of the weight plug and screw assembly shown in FIG. 12.

The weight plug 100 is reversibly secured within the heel side opening 70 with a screw 150, which comprises a head portion 152, an unthreaded midsection 154, and a threaded tip 156. The weight plug 100 is attached to the screw 150 by sliding the head portion 152 into the slotted side opening 120, as shown in FIGS. 9-11, so that a tool-engagement section 151 of the head portion 152 is aligned with the through-opening 110 of the weight plug 100. The U-shaped flange 130 extends around a portion of the unthreaded midsection 154, and one or more washers 160 are disposed between the head portion 152 and the U-shaped flange 130. As shown in FIG. 16, one or more o-rings 170 can also be attached to the midsection 154 above and/or below the u-shaped flange 130 to cushion the contact between, and secure, various parts of the assembly.

The weight plug 100 and screw 150 combination is then inserted into the heel-side opening 70 so that the U-shaped flange 130 abuts or is proximate the internal flange 63, the unthreaded midsection 154 extends through the through-opening 64, and the threaded tip 156 of the screw 150 engages the threaded tip end 84 of the shaft sleeve 80. A torque wrench, screwdriver, or other tool (not shown) fits through the through-opening to engage the tool-engagement section 151 and tighten the screw 150, which pulls the weight plug 100 and the shaft sleeve 80 towards one another so that they sandwich the internal flange 63 of the hosel 60 between the U-shaped flange 130 and the tip end 84 of the shaft sleeve 80. The weight plug 100 is thereby directly connected to the shaft sleeve 80, but not directly connected to the body 20 of the golf club head 10.

An alternative embodiment of the present invention is shown in FIGS. 12-16. In this embodiment, the golf club head 10 has many of the same features as the preferred embodiment, but is a fairway wood head having separate body 20 and face components 55, and a shallower heel-side opening 70 than the preferred embodiment. This golf club head 10 also includes a toe-side weight port 35 having approximately the same shape and dimensions as the heel-side opening 70, and an additional weight plug 115 having the same features as the first weight plug 100 but a different mass and/or material composition. The additional weight plug 115 is secured within the toe-side weight port 35 with a screw or other fastening device (not shown), and is interchangeable with the other weight plug 100 within the heel-side opening 70 so that a golfer can adjust the draw bias of the golf club head 10. In this embodiment, the first weight plug 100 has a mass of 8.5 grams, the additional weight plug 115 has a mass of 4.5 grams, and the golfer can adjust the draw bias by changing the location of the weight plugs 100, 115 in the body 20. Each of the weight plugs 100, 115 of this embodiment preferably has a mass of no more than 10 grams.

The weight plug 100 of the present invention preferably comprises a metal material, such as titanium alloy, steel, or aluminum alloy, and is more preferably entirely composed of metal, though in alternative embodiments it may be composed of a polymer dosed with a dense metal such as tungsten. The shaft sleeve 80 preferably is composed of a less dense material than the weight plug 100, such as aluminum alloy, and the washers 160 and o-rings 170 may be composed of any material known to a person skilled in the art.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf club head comprising:

a body comprising a face portion, a sole portion, a crown portion, a heel side, a toe side, and a heel-side opening extending into the sole portion;

a hosel comprising a hosel bore and an internal hosel flange extending into and at least partially encircling the hosel bore;

a shaft sleeve comprising a shaft sleeve tip end with an internally threaded opening;

a first weight plug comprising a wall, a base end, a plug flange opposite the base end, a side opening extending into the wall proximate the plug flange, and a through-opening extending from the base end to the side opening;

a screw comprising a head portion, a midsection, and a threaded tip portion sized to engage the threads of the internally threaded opening in the shaft tip end; and a washer disposed between the head portion of the screw and the plug flange, wherein the heel-side opening communicates with the hosel bore, wherein the first weight plug is sized to fit within the heel-side opening, and wherein, when the first weight plug is disposed within the heel-side opening and the shaft sleeve is disposed within the hosel bore, the screw connects the weight plug to the shaft sleeve so that the internal hosel flange is sandwiched between the plug flange and the shaft tip end.

2. The golf club head of claim 1, wherein the plug flange is approximately U-shaped, wherein the head portion of the screw is disposed within the side opening of the first weight plug, and wherein the plug flange extends around a portion of the midsection of the screw.

3. The golf club head of claim 1, wherein the base end is angled with respect to the first weight plug wall, and wherein the first weight plug has a width that tapers from a maximum width proximate the base end to a minimum width proximate the plug flange.

4. The golf club head of claim 1, wherein the wall of the first weight plug has a varying thickness.

5. The golf club head of claim 1, wherein the body comprises a secondary weight port, wherein the secondary weight port is spaced from the heel-side opening, and wherein the first weight plug is sized to fit within the secondary weight port.

6. The golf club head of claim 5, wherein the golf club head further comprises a second weight plug, wherein the first weight plug has a first mass, wherein the second weight plug has a second mass that is different from the first mass.

7. The golf club head of claim 6, wherein each of the first and second weight plugs is sized to fit within the heel-side opening and the secondary weight port.

8. The golf club head of claim 5, wherein the secondary weight port extends into the toe side of the body.

9. The golf club head of claim 1, wherein the first weight plug has a mass of no more than 10 grams.

10. A golf club head comprising:

a body comprising;

a sole portion;

a crown portion;

a heel side;

a toe side;

a hollow interior cavity;

a hosel having a hosel bore and a hosel flange extending into the hosel bore; and a heel-side opening extending into the sole portion in communication with the hosel bore;

a shaft sleeve comprising an internally threaded tip end, the tip end sized to fit within the hosel bore;

a weight plug comprising a wall, a base end, a u-shaped flange opposite the base end, a side opening extending into the wall proximate the u-shaped flange, and a through-opening extending from the base end to the side opening;

a screw comprising a head portion, an unthreaded mid-section, and an externally threaded tip portion sized to engage the internally threaded tip end of the shaft sleeve; and at least one washer, wherein the weight plug is sized to fit within the heel-side opening, wherein the weight plug has a width that tapers from a maximum width proximate the base end to a minimum width proximate the plug flange, wherein the at least one washer at least partially encircles the unthreaded midsection of the screw, wherein, when the weight plug is disposed within the heel-side opening and the tip end of the shaft sleeve is disposed within the hosel bore, the screw connects the weight plug to the shaft sleeve so that the hosel flange is disposed between the plug flange and the shaft tip end, and wherein tightening the screw causes the weight plug and the shaft sleeve to move towards one another.

11. The golf club head of claim 10, wherein the shaft sleeve is composed of a first material, and wherein the weight plug is composed of a second material that differs from the first material.

12. The golf club head of claim 11, wherein the weight plug comprises a tungsten alloy.

13. The golf club head of claim 10, wherein the base end is approximately flush with an external surface of the sole portion.

14. The golf club head of claim 10, wherein the base end of the weight plug is painted to blend in with an external surface of the sole portion.

15. An assembly comprising:

a golf club shaft sleeve comprising a tip end having a threaded internal bore;

a weight plug comprising a wall, a base end, a u-shaped flange, a side opening, and a through opening extending from the base end to the flange and in communication with the side opening;

a screw comprising a head portion, an unthreaded mid-section, and threaded tip portion;

at least one washer; and at least one o-ring, wherein the at least one washer and at least one o-ring at least partially encircle the unthreaded midsection, wherein the head portion is disposed within the side opening so that the u-shaped flange extends around a portion of the unthreaded midsection, wherein the threaded tip portion engages the threaded internal bore, and wherein the screw reversibly attaches the weight plug to the shaft sleeve.

16. The assembly of claim 15, wherein the wall of the weight plug has a varying thickness.

17. The assembly of claim 15, wherein the golf club shaft sleeve is composed of a first material, and wherein the weight plug is composed of a second material that differs from the first material.

18. The assembly of claim 17, wherein the golf club shaft sleeve is composed of an aluminum alloy, and wherein the weight plug is composed of a titanium alloy.

19. The assembly of claim 15, wherein the weight plug comprises a tungsten alloy.

20. The assembly of claim 15, wherein the weight plug has a mass of no more than 10 grams.

* * * * *